US007246457B2

(12) United States Patent
Mieger et al.

(10) Patent No.: US 7,246,457 B2
(45) Date of Patent: Jul. 24, 2007

(54) CONSTRUCTION MACHINE WITH A QUICK COUPLER

(75) Inventors: Rolf Mieger, Kirchedorf-Unteropfingen (DE); Thomas Zitterbart, Dietenheim (DE)

(73) Assignee: Liebherr-Hydraulikbagger GmbH, Kirchdorff/Iller (DE)

( * ) Notice: Subject to any disclaimer, the term of this patent is extended or adjusted under 35 U.S.C. 154(b) by 256 days.

(21) Appl. No.: 11/062,094

(22) Filed: Feb. 18, 2005

(65) Prior Publication Data

US 2005/0204591 A1 Sep. 22, 2005

(30) Foreign Application Priority Data

Feb. 18, 2004 (DE) ..... 20 2004 002 541 U

(51) Int. Cl.
*E02F 3/96* (2006.01)

(52) U.S. Cl. ..... 37/468; 37/403; 172/272; 414/723

(58) Field of Classification Search ..... 37/468, 37/403, 404, 405–410; 172/272–275; 414/723, 414/694

See application file for complete search history.

(56) References Cited

U.S. PATENT DOCUMENTS

| | | | | |
|---|---|---|---|---|
| 5,484,250 | A * | 1/1996 | Gilmore et al. | 414/723 |
| 6,116,699 | A * | 9/2000 | Kaczmarski et al. | 299/39.5 |
| 6,301,811 | B1 * | 10/2001 | Gilmore, Jr. | 37/468 |
| 6,428,265 | B1 * | 8/2002 | Gilmore, Jr. | 414/723 |
| 6,438,874 | B1 * | 8/2002 | LaBounty et al. | 37/403 |
| 6,542,789 | B2 | 4/2003 | Ufheil | |
| 6,860,705 | B1 * | 3/2005 | Dietrich et al. | 414/680 |
| 6,899,509 | B1 * | 5/2005 | Mailleux | 414/723 |
| 7,004,712 | B2 * | 2/2006 | Martin | 414/723 |
| 7,114,271 | B2 * | 10/2006 | Chagnot et al. | 37/352 |
| 2005/0155258 | A1 * | 7/2005 | Nishimura et al. | 37/403 |

FOREIGN PATENT DOCUMENTS

| | | | |
|---|---|---|---|
| DE | 10011499 | * | 9/2001 |
| DE | 10159417 | | 9/2002 |
| DE | 20209518 | | 10/2003 |
| DE | 20219518 | | 10/2003 |
| DE | 20212540 | | 12/2003 |
| EP | 0989242 | | 3/2000 |
| FR | 2676765 | * | 11/1992 |
| WO | 91/01414 | | 2/1991 |

* cited by examiner

*Primary Examiner*—Thomas A Beach
(74) *Attorney, Agent, or Firm*—Dilworth & Barrese LLP

(57) ABSTRACT

The invention relates to a construction machine with a quick coupler for the coupling of a tool to a boom having a quick coupling part on the boom side and a quick coupling part on the tool side having a power circuit coupling, in particular a hydraulic coupling, having plate-like supports of the power coupling parts for the automatic coupling of a power connection on the tool side to a power connection on the boom side. In accordance with the invention, a write/read head is arranged in or at one of the two plate-like supports. Furthermore, a data carrier is arranged in the oppositely disposed plate-like support such that both can exchange data with one another in the coupled state.

20 Claims, 7 Drawing Sheets

CONSTRUCTION MACHINE WITH A QUICK COUPLER

BACKGROUND OF THE INVENTION

The present invention relates to a quick coupler for the coupling of a tool to a boom having a quick coupling part on the boom side and a quick coupling part on the tool side having a circuit coupling, including a hydraulic coupling, having plate-like supports for the power coupling parts for the automatic coupling of a power connection at the tool side to a power connection at the boom side, with male or female connector pieces being integrated in the plate-like supports, on the one hand, as power connections and with at least one guide bolt or at least one guide bore being integrated spaced apart therefrom in the plate-like supports, which ensure an exactly fitting lying of the plate-like supports on top of one another in the coupled state such that the plate-like supports are arranged largely parallel to one another while forming a small gap.

Quick couplers of the pivot type are widespread in hydraulic excavators, since they permit a simple and fast change of different tools such as hydraulic grabs, digging-stripping shovels, gripping tongs and the like. Initially, only one of the two latching axles has to be positioned and brought into engagement for the coupling. It can advantageously be a cross bolt which is hung into a hook-like eyelet on the oppositely disposed coupling part. The coupling part at the boom side can then be pivoted relative to the tool around the latching axle already brought into engagement, in order hereby to find the latching position in which the second latching axle can be latched. The latter is, as a rule, formed by a pair of latching bolts which can move apart and into corresponding latching bores on the oppositely disposed quick coupling part.

Such a quick coupling of the pivot type is known from WO 91/01414 in which an automatic hydraulic coupling is provided which automatically couples a power circuit on the boom side to a power circuit on the tool side on the pivoting together of the two quick coupling parts. Power coupling parts are admittedly provided, of which one is fastened to the quick coupling on the boom side and the other is fastened to the quick coupling part on the tool side, and indeed such that the two power coupling parts are moved toward one another and are brought into engagement when the two quick coupling parts are pivoted together around the first, already latched latching axle. One of the two power coupling parts is movably supported on the corresponding quick coupling part to compensate the circular movement of the quick coupling parts when pivoted together.

A generic coupling is known from DE 101 59 417 C2. To permit a leak-free and defect-free coupling of the power circuits on the boom side and on the tool side, in this prior-known quick coupling, a linear guide for the power coupling parts is known which forces the power coupling parts against the circular pivot movement into a relative movement with respect to one another along a straight line. To permit the compensation of the pivot movement, at least one of the two power coupling parts is movably supported on the corresponding quick coupling part relative thereto, and indeed pivotable around an axle parallel to the first latching axle of the quick coupling parts and perpendicular thereto. Provision is made in this process for the movably supported power coupling part to compensate the pivot movement by a linear guide on the moving together of the quick coupling parts and to move precisely such that an exactly linear movement takes place between the two power coupling parts. At least one guide bolt or one guide bore serve for this purpose, which engage into one another on coupling and ensure an exactly fitting lying of plate-like supports on top of one another in the coupled state such that the plate-like supports are arranged largely parallel to one another while forming a small gap in the coupled state.

BRIEF SUMMARY OF THE INVENTION

The use of quick tool changers and the possibility of simultaneously also establishing the required power supply of an electrical or hydraulic kind with the coupling process facilitates the reception of different tools. This simplified extension, however, results in the problem that technical problems or technical safety problems which may occur are not registered by the operator of the construction machine. A technical problem can thus consist of the fact, for example, that, on the addition of a hydraulically driven tool, the hydraulic pressure of the hydraulic device on the construction machine side, the output or also the oil used do not match the tool added on. This can, on the one hand, result in functional incapability, but on the other hand also to the destruction of the tool. Technical safety problems result, for example, by the addition of a shovel which is too large or too heavy, since the stability of the construction machine is here no longer ensured on the lifting of loads. However, the addition of a shovel which is too small or too light also results in problems.

SUMMARY OF THE INVENTION

It is the object of the invention to further develop a generic construction machine with a quick coupling such that technical or technical safety risks on the automatic coupling of the tool to a construction machine are reliably prevented.

This object is satisfied in accordance with the invention, starting from a generic construction machine with the quick coupling, by the combination of the features herein. Accordingly, a read/write head is arranged in or on one of the two plate-like supports and a data carrier is arranged in the oppositely disposed plate-like support such that both can exchange data with one another in the coupled state.

The data carrier used in accordance with the invention works inductively. The read/write head only reliably exchanges data with this data carrier when a low spacing of, for example, approx. 3–5 mm is exactly observed. This is ensured in the present system in that the plate-like supports lie on one another in a precise fit in the coupled state. The system consisting of the write/read head, on the one hand, and the data carrier, on the other hand, can also simultaneously be used as a security system by this property since here an exchange of data can only take place when, on the one hand, the read/write head and, on the other hand, the data carrier lie in their desired position, that is when the low spacing of the 3–5 mm is observed. This is, however, only the case when the latching bolt engages correctly and connects the system and closes the coupling. If the bolt would accidentally not close, the spacing would be so large that the write/read head could actually not exchange any data with the data carrier.

Due to the design in accordance with the invention, both the write/read head and the data carrier are, in a similar manner to the hydraulic couplings, accommodated in a protected manner in the plate-like supports of the quick-couplers. Damage and also an interruption to the system in operation is suppressed by the installation of the write/read head, on the one hand, and of the data carrier, on the other hand, in the plate-like support which represents a type of "shielded steel plate, and by the low spacing as was previously presented. Operation is thereby also possible in security-sensitive areas such as in the technical nuclear area. If, for example, a radio system with a large transmission path were used here, secure operation would not necessarily be possible since the proneness to problems increases proportionally as the transmission path increases.

The tool recognition means consisting of the write/read head and the data carrier, which are designed as an inductive system, for example, can only be made possible by the constant observation of the spacing of the plate-like supports from one another.

A problem-free position recognition of the SWA is made possible in connection with this possibility of tool recognition in accordance with the invention in conjunction with the monitoring system already used today with construction machinery. Security is hereby increased.

Preferred aspects of the invention result from the description herein.

Accordingly, at least one of the two plate-like supports can be part of a resilient compensation system. Such a compensation system permits a minimum gap spacing so that the desired position for the write/read head, on the one hand, and the data carrier, on the other hand, can be adopted in a defined manner. The type of the corresponding compensation system has already been described, for example, in DE 101 59 417 C2 to which reference is made here.

Accordingly, the compensation system can take place in accordance with a further aspect of the invention by means of compression springs on which the respective plate-like supports are supported.

The optimum alignment of the plate-like supports with respect to one another is always ensured by this compensation system and in particular by the spring support. The write/read head, and also the data carrier, can be arranged inside the plate-like supports. In accordance with a special aspect of the invention, the write/read head, and also the data carrier, can, however, also be arranged at extension parts which adjoin the plate-like supports.

A cleaning system present for the coupling system can also be used simultaneously as a cleaning system for the write/read head and the data carrier. This is in particular advantageous on the use of construction machinery in which particularly the surfaces of the plate-like supports can become dirty.

Complete data records with information specific to the tool can be contained on the data carriers.

Furthermore, the complete data records, which are stored on the data carrier, can also include operating data such as data on the period of use of the tool. Such data are of particular interest for different applications. On a use as a rental tool, for example, a precise billing can thus be made by the lessor in accordance with the corresponding use. Data can be determined as to which tool was used for how long on which excavator. The different data for the respectively used tools can be recorded in a memory of the data processor of the excavator so that a total billing of the excavator can be calculated here. Data of the tool can also be read out externally via a corresponding data interface through an interface on the excavator so that they can be uploaded centrally at a monitoring station.

On a corresponding coupling of the tool to the excavator, the automatic tool recognition permits the output of a warning when the tool is not suitable for the respective excavator or for the work to be done.

The identification of the tool also permits the excavator to be protected in that it can, for example, be avoided here that a tool with the wrong hydraulic oil can be coupled. It is advantageously possible, in addition to the possibility of recognizing the shape and position of a coupled tool (for example, display on a screen) and to the possibility of calculating the stability of the construction machine, to limit the forces acting on the tool for the protection of the tool or of the excavator. For example, a shovel which has dimensions which are too weak can thus be protected from destruction. It is, however, also possible for the tool to advise a maximum load which may not be exceeded an the basis of a forced limitation to be provided in this manner. This can result, for example, in a uniform, optimum compaction with, for example, an added vibrating plate, an added roller compactor or the like. On the other hand, it can also permit a compaction measurement. The controlled observation of a maximum force can make the use of a corresponding construction machine for the transfer of materials, for example an excavator, safer. The base of a hull can, for example, thus be protected by a force limitation of an excavator grab.

Further features, details and advantages of the invention will be explained in more detail with reference to an embodiment shown in the drawing.

There are shown:

DETAILED DESCRIPTION OF THE INVENTION

Figure 1:
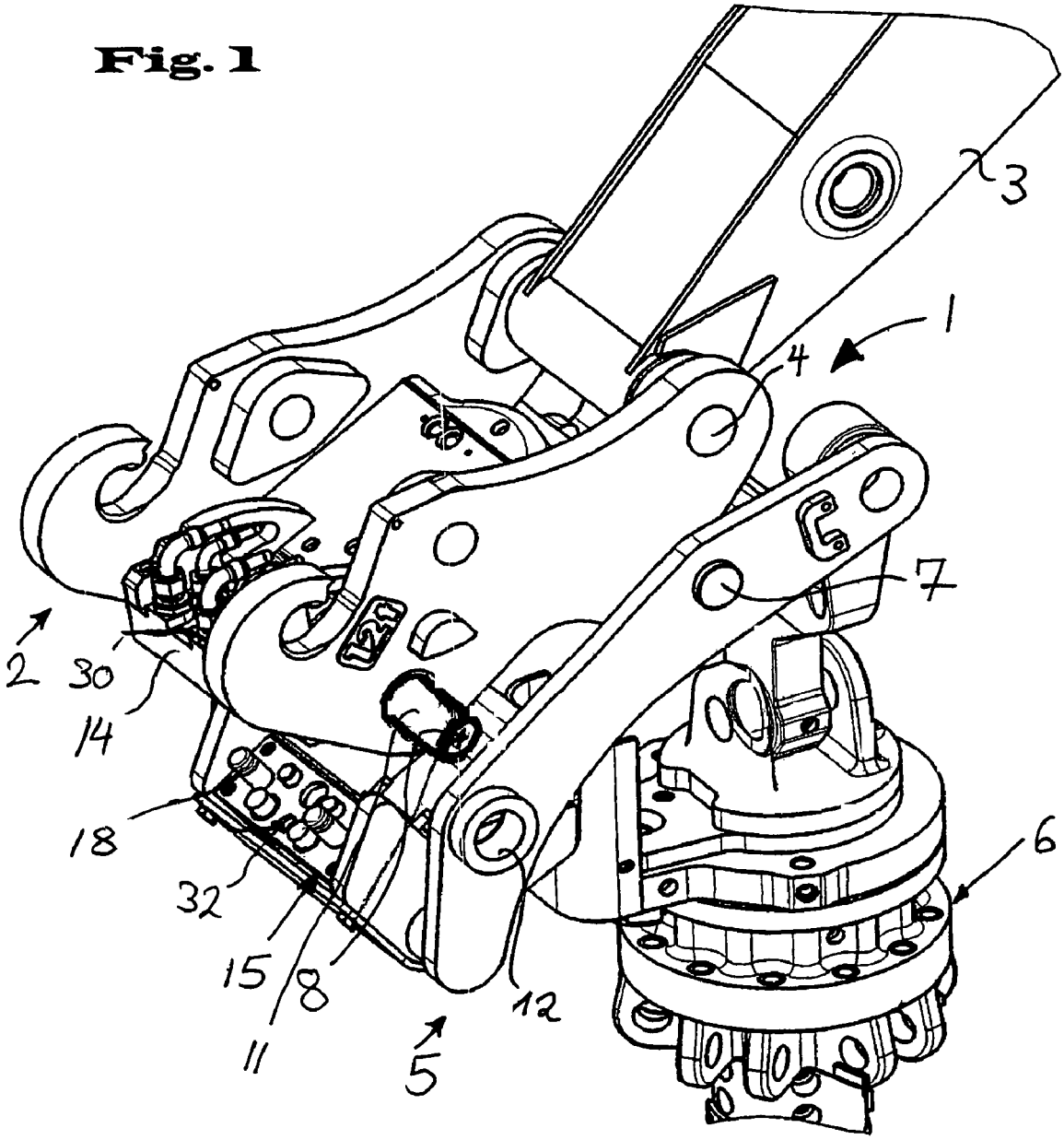
FIG. 1 a perspective view of a quick coupler in accordance with a preferred embodiment of the invention which has a pair of mechanical quick coupling parts and a hydraulic coupling, with the mechanical quick coupling parts only being in engagement with one of two latching axles and the hydraulic coupling not yet being coupled.

The quick coupler 1 shown in the Figures has a quick coupling part 2 on the boom side which is pivotably secured to the shaft 3 of a boom of a hydraulic excavator and can be pivoted about the pivot axis 4 perpendicular to the longitudinal axis of the shaft 3 in a manner known per se via a pivot tab not shown in any more detail. The quick coupler 1 furthermore has a quick coupling part 5 on the tool side which is connected to a hydraulic excavator tool. It can e.g. be a grab tool with a rotary mechanism 6 which is hydraulically actuable.

The two parts 2 and 5 of the quick coupler 1 are latchable to one another via two parallel latching axles 7 and 8 spaced apart from one another. The latching axles 7 and 8 extend, as shown in FIG. 1, parallel to the pivot axis 4 around which the quick coupler 1 can be pivoted relative to the shaft 3. In FIG. 1, the latching bolt 8 is shown in the moved out representation. It can be moved in and out hydraulically.

The first of the two latching axles 7 is formed, on the one hand, by a transverse bolt 9 provided at the quick coupling part 5 on the tool side and by a pair of latching hooks 10 provided at the quick coupling part 2 on the boom side. The latching hooks 10 can be hooked in to the transverse bolt 9 so that it can be gripped by the latching hooks 10 and the quick coupling part 5 on the tool side can be raised (cf. FIG. 6).

Figure 2:
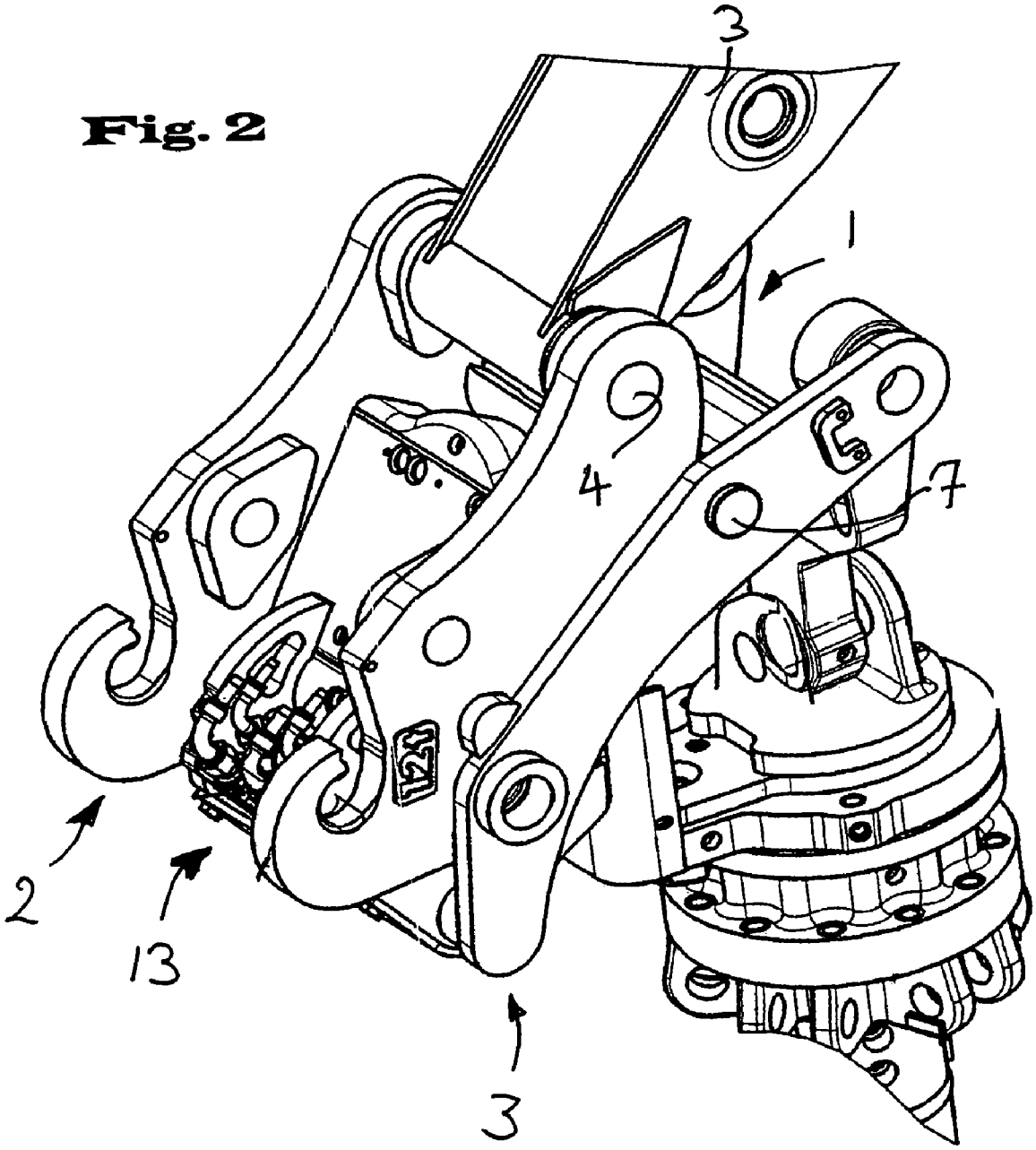
FIG. 2 a perspective view of the quick coupling in accordance with FIG. 1, with the quick coupling parts being shown in the stated pivoted together with a coupled hydraulic coupling.
Figure 6:
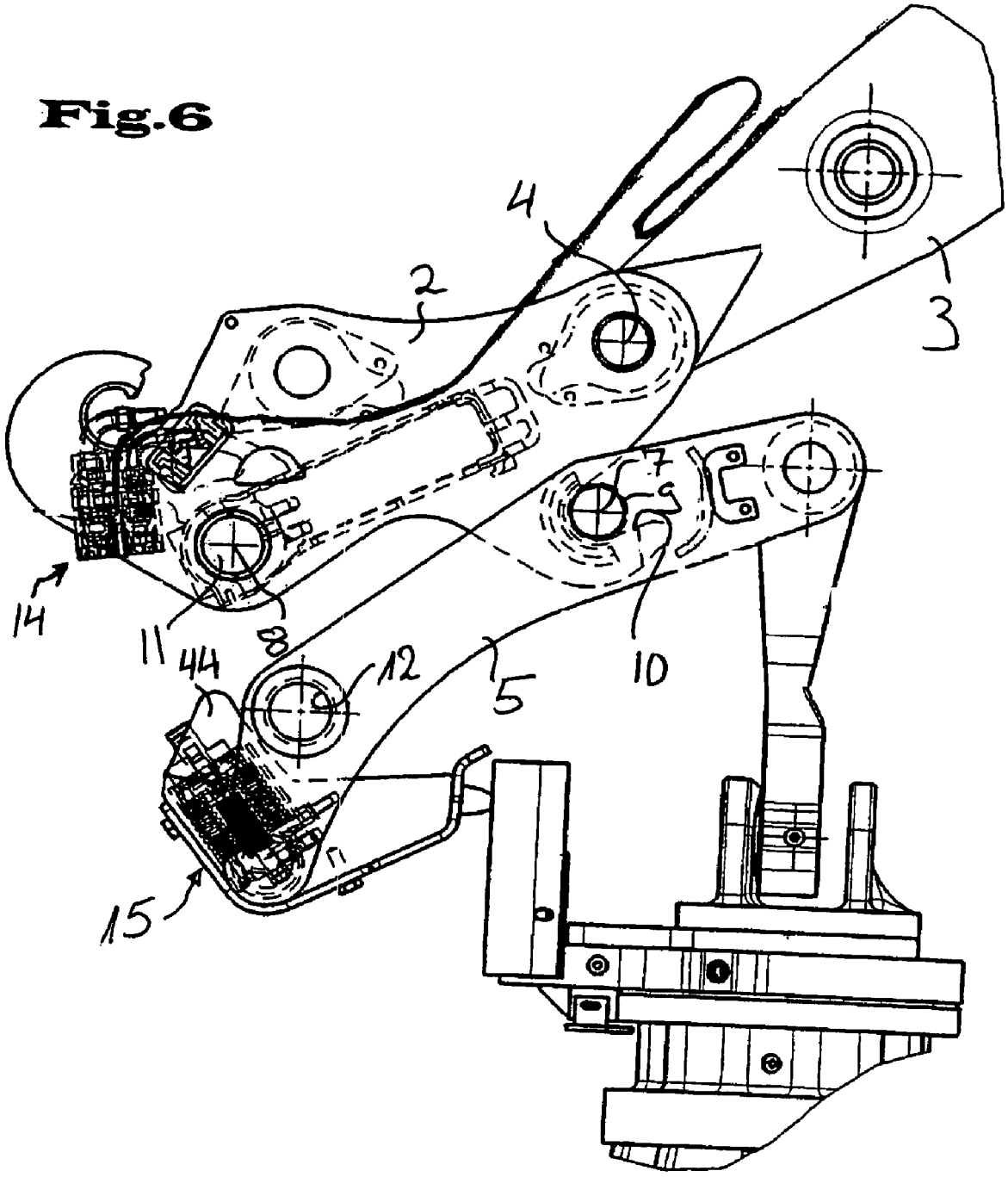
FIG. 6 a side view of the quick coupler in accordance with the preferred embodiment of the invention shown here.

As FIG. 2 or 6 shows, latching hooks 10 are hook-shaped recesses which are open at one side and surround the transverse bolt in half-shell form. The hook recesses are open at that side of the quick coupling part 2 which faces away from the second latching axle 8.

The second latching axle 8 is formed, on the one hand, by a latching bolt pair 11, which can be moved apart, and by an associated pair of latching bores 12. As FIG. 6 shows, the latching bolt pair 11 is arranged at the quick coupling part 2 on the boom side and can preferably be moved in and out hydraulically by a drive mechanism known per se. The latching bores 12 are formed in the quick coupling part 5 on the tool side. As can be recognized from FIG. 1, both the quick coupling part 2 on the boom side and the quick coupling part 5 on the tool side have support pieces which are spaced apart from one another, substantially vertical and are spaced apart from one another differently such that the plate-like supports of the quick coupling part on the boom side can move in between the plate-like supports of the quick coupling parts 5 on the tool side.

To couple the two quick coupling parts 2, the quick coupling part 2 on the boom side is first moved into the quick coupling part 5 on the tool side and is engaged with the hook-like latching recesses 10 of the transverse bolts of the oppositely disposed quick coupling part (cf. FIG. 6). It can be ensured by a slight raising of the quick coupling part 2 on the boom side that the quick coupling part 5 on the tool side reliably falls into the hook-like latching recess 10. To latch the second latching axle 8, the quick coupling part 2 on the boom side is then pivoted around the pivot axis 4 such that, as a result, the two quick coupling parts 2 and 5 are pivoted together around the first latching axle 7. The two quick coupling parts 2 and 2 are pivoted together so far that the latching bolt pair 11 and the associated latching bores 12 coincide with one another. The latching bolts 11 are then preferably moved apart by hydraulic charging such that they move into the latching bores 12. The two quick coupling parts 2 and 5 are firmly latched to one another by the two latching axles 7 and 8.

To prevent an offset of the two quick coupling halves and thus any damage to the sensitive hydraulic coupling on the pivoting of the two quick coupling parts 2 and 5 around the first latching axle 7, the two quick coupling parts 2 and 5 can be provided with a pivot guide 44 (cf. FIG. 6).

To provide power to drive elements on the tool side, a hydraulic coupling 13 is associated with the quick coupler 1 and connects a hydraulic circuit on the boom side to a hydraulic circuit on the tool side; e.g. the rotary mechanism in accordance with FIG. 1 can be operated hydraulically. Further drive elements and accordingly more hydraulic circuits can be provided and coupled.

The hydraulic coupling 13 comprises two power coupling parts 14 and 15 which are mounted to the quick coupling part 2 on the boom side, on the one hand, and to the quick coupling part 5 on the tool side, on the other hand.

They are arranged on sides of the quick coupling parts 2 and 5 disposed opposite the first latching axle 7 and 8, and indeed each at the same spacing from the first latching axle 7 such that they move toward one another on the pivoting together of the two quick coupling parts 5. They could generally also be arranged between the two latching axles 7 and 8. However, they preferably lie outside the region bounded by the two latching axles 7 and 8, since experience has shown that the latter is prone to contamination and is difficult to access. By the arrangement of the power coupling parts 14 and 15 outside the latching axles 7 and 8, they are less sensitive and easier to maintain. As FIG. 1 shows, the power coupling parts 14 and 15 are each arranged between the perpendicular support pieces 16 of the quick coupling part 2 on the boom side or the perpendicular support pieces 17 of the quick coupling part 5 on the tool side. They are hereby protected. They in particular do not project beyond the quick coupling parts 2 or 5 such that the power coupling parts 14 and 15 would be pressed into the ground when the corresponding quick coupling parts 2 are put down on the ground.

Both power coupling parts 14 and 15 combine a plurality of power couplings. They are each made as a connector block in which a plurality of connector pieces 18 are combined.

Figure 3:
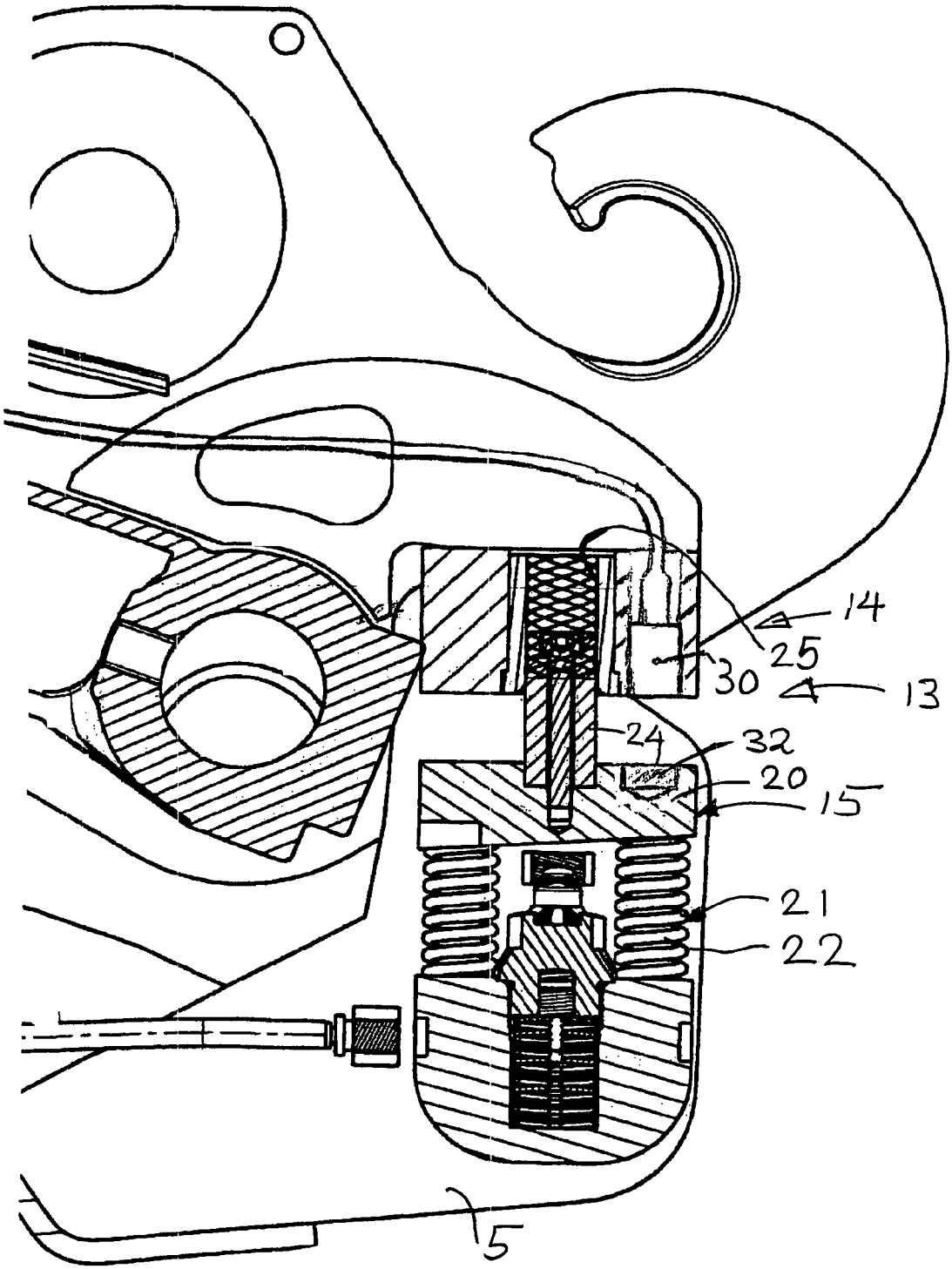
FIG. 3 an enlarged partially sectional view of the quick coupler which shows the hydraulic coupling just before the coupling couples.

In accordance with the embodiment shown in FIG. 1, the plate-like support of the power coupling part 14 arranged at the quick coupling part 2 on the boom side is firmly supported, i.e. it is rigid relative to the quick coupling part 2. The plate-like support of the power coupling part 15 secured to the quick coupling part on the tool side is movably supported thereon. As FIG. 3 shows, the whole power coupling part 15 is seated on a spring arrangement 21 which, in the embodiment shown, consists of four compression springs arranged in a rectangle. The compression springs 22 are secured, on the one hand, to bracket plates arranged in the perpendicular support pieces of the quick coupling part 5 on the tool side. On the other hand, the cylindrical spring elements 22 are connected, preferably screwed, to the plate-like support 20 of the power coupling part 15. The springs 22 have a sufficient height and elasticity such that the power coupling part 15 can be displaced or tilted through multiple axes. The spring arrangement 21 forms a support for the power coupling part 15 movable through multiple axes so that the latter can compensate an offset to the oppositely disposed power coupling part 14, in particular due to the pivot movement of the quick coupling parts 2 and 5.

As can be seen from FIG. 6, the two power coupling parts 14 and 15 move together with the quick coupling parts 2 and 5 automatically and synchronously due to the pivoting together movement thereof. The power coupling parts 14 and 15 undergo a circular movement around the first latching axle 7 in this process. Since the connector pieces 18 on the two power coupling parts 14 and 15, however, have to be moved together in a linear manner, the pivot movement of the energy coupling parts 14 and 15 is compensated by means of the spring arrangement 21. To ensure a precisely linear movement, a linear guide is associated with the hydraulic coupling 13 and ensures that the power coupling parts 14 and 15 are moved toward one another precisely along a straight line despite the pivot movement of the quick coupling parts 2 and 5. The linear guide 23 in the embodiment drawn consists of a pair of guide bolts 24 and associated guide bores 25 (cf. FIG. 3) which move in the said guide bolts 24 on the moving together of the two power coupling parts 14 and 15. In this process, they force the springs 22 to make a deflection to compensate the pivot movement component. Offset as a result of tolerances in the assembly is moreover likewise compensated (cf. FIGS. 3 and 4).

Figure 4:
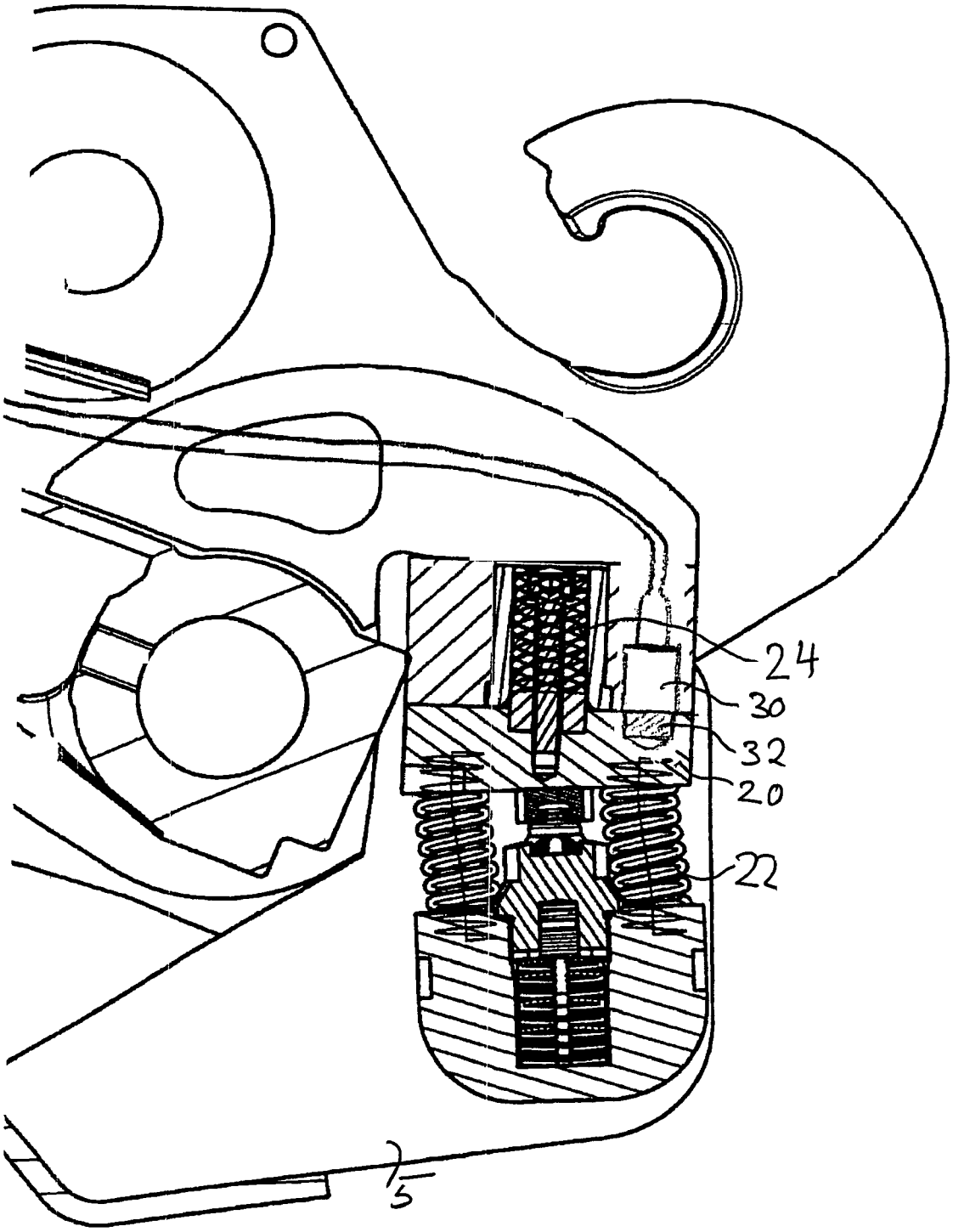
FIG. 4 a partially sectional view similar to that of FIG. 4, with the hydraulic coupling being shown in the state completely moved together.

As can in particular be recognized in FIGS. 3 and 4, a write/read head 30 is arranged in the plate-like support of the power coupling part 15 and a data reader 32 is arranged in the plate-like support 20 of the power coupling part 15. The write/read head 30 and the data carrier 32 must only have a minimal spacing of a few millimeters from one another in the coupled state, as shown in FIG. 4, in order to transfer the data (inductive system). Due to the aforesaid latching mechanism, it is, however, ensured that the power coupling parts 14 and 15 exactly come to lie on one another. It is hereby ensured that the write/read head 30, on the one hand, and the data carrier 32, on the other hand, are arranged in the precisely aligned position with respect to one another.

Figure 5:
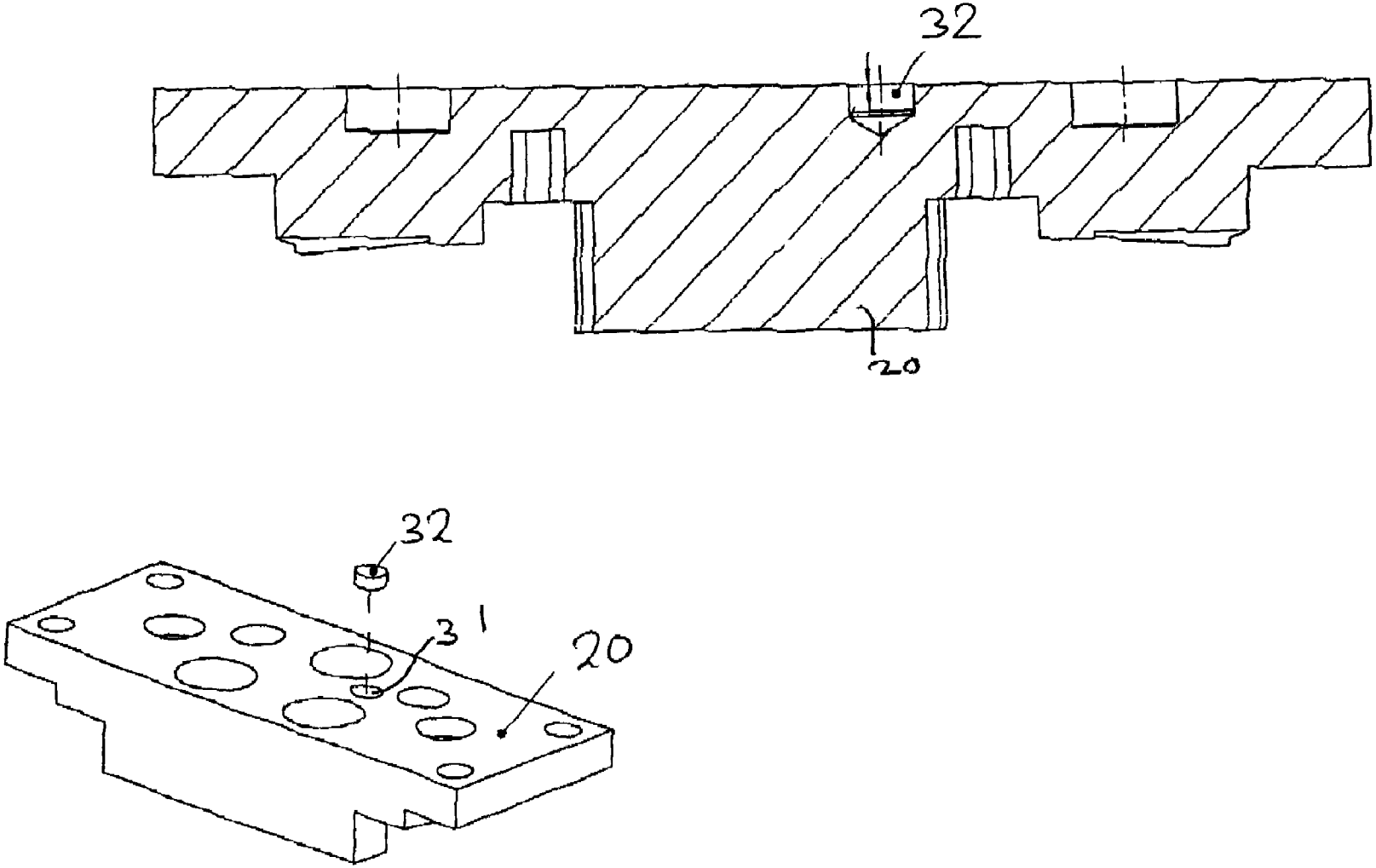
FIG. 5 a sectional representation of a component of the coupling and a perspective representation of the same.

In FIG. 5, the plate-like support 20 is shown in section and in a perspective view. In section, the data carrier 32 is inserted in the plate-like support 20. In the corresponding perspective representation, the data carrier 32 is shown still before the insertion into the corresponding reception opening 31 of the plate-like support 20. The data carrier 32 can, for example, be adhesively bonded into the opening.

Figure 9:
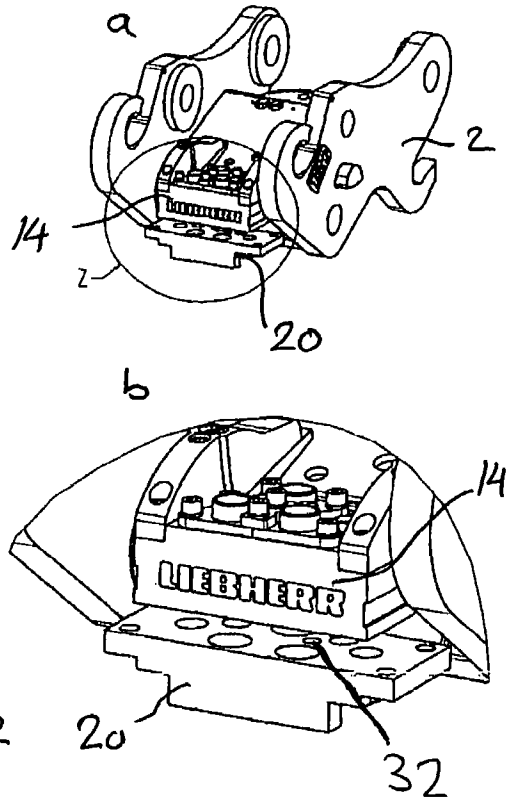
FIGS. 7, 8 and 9 perspective views of parts of the quick coupler in accordance with the present invention and enlarged detail representations associated for this purpose.
Figure 8:
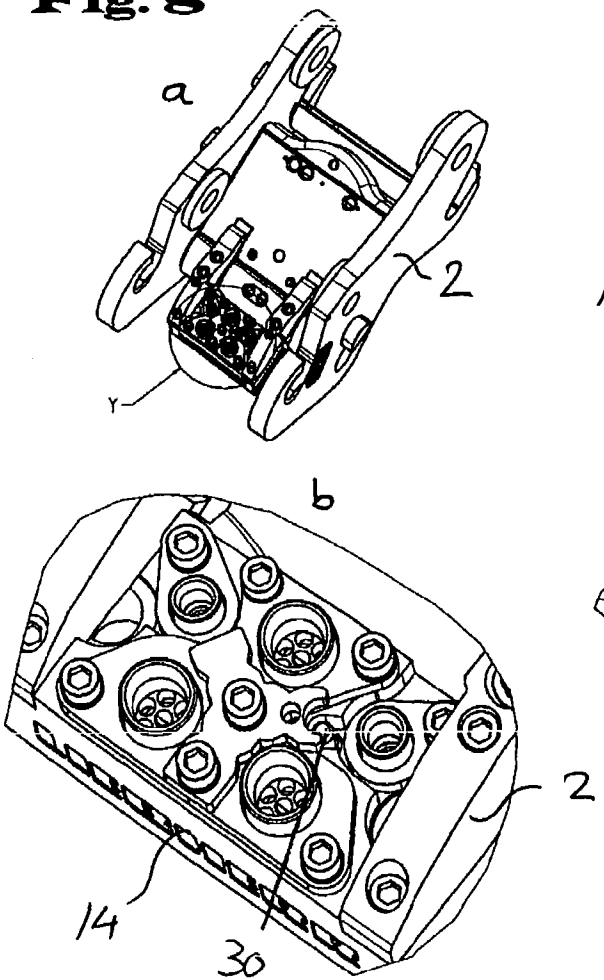
Figure 7:
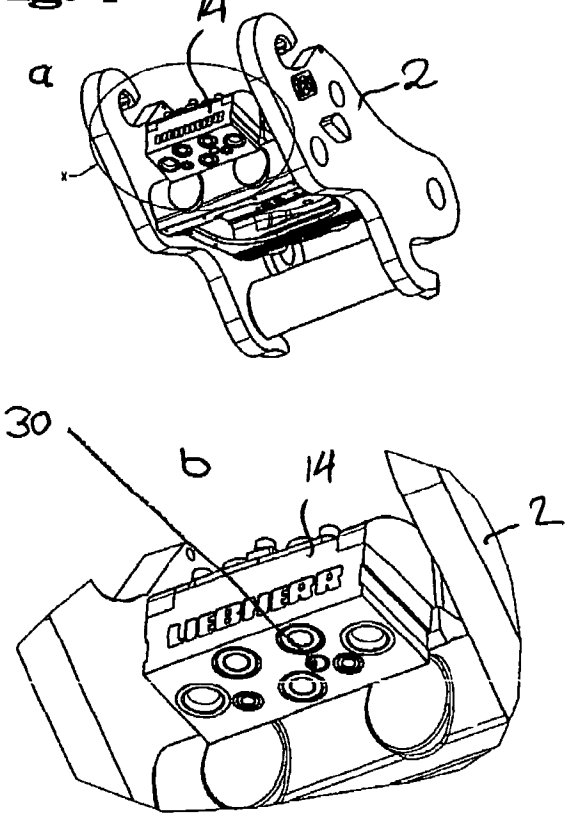

The precise positioning of the respective write/read head or of the data carrier becomes clear from FIGS. 7, 8 and 9 and the respective details.

In FIG. 1 the quick coupler is shown in the state not yet coupled. Here, the corresponding latching bolts 11 are, however, already moved out such that a correct coupling by moving in the latching bolts 11 into the corresponding latching bores 12 is no longer possible. In this state, the write/read head 30 and the data carrier 32 cannot communicate with one another because they are too far apart. A security is hereby simultaneously provided in the event that the quick coupler is not correctly coupled.

The invention claimed is:

1. A construction machine with a quick coupler for the coupling of a tool to a boom having a quick coupling part on the boom side and a quick coupling part on the tool side having a power circuit coupling, in particular a hydraulic coupling, having a plate-like supports of the power coupling parts for the automatic coupling of a power connection on the tool side to a power connection on the boom side, with there being integrated in the plate-like supports, on the one hand, male and female connector pieces as energy connections and, spaced apart therefrom, at least one guide bolt or at least one guide bore which ensure a precisely fitting lying on one another of the plate-like supports in the coupled state such that the plate-like supports are arranged largely parallel to one another while forming a small gap, wherein a write/read head is arranged in or at one of the two plate-like supports and a data carrier is arranged in the oppositely disposed plate-like support such that both can exchange data with one another in the coupled state.

2. A construction machine with a quick coupler in accordance with claim 1, wherein at least one of the two plate-like supports is part of an elastic compensation system.

3. A construction machine with a quick coupler in accordance with claim 2, wherein the respective plate-like support is supported on compression springs to form the elastic compensation system.

4. A construction machine with a quick coupler in accordance with claim 1, wherein both the write/read head and the data carrier are arranged on added parts adjacent to the plate-like supports.

5. A construction machine with a quick coupler in accordance with claim 1, wherein complete data records with the information specific to the tool are included on the data carrier.

6. A construction machine with a quick coupler in accordance with claim 5, wherein the complete data records also include operating data such as data on the period of use of the tool.

7. A construction machine with a quick coupler in accordance with claim 1, wherein a cleaning system which is in present for the coupling system and which can be set onto the plate-like support can also be used for the cleaning of the surface of the write/read head and of the surface of the data carrier.

8. A construction machine with a quick coupler in accordance with claim 1, wherein the forces to be transmitted from the construction machine to the tool can be limited in pre-settable ranges in accordance with the transmitted data.

9. A construction machine with a quick coupler in accordance with claim 2, wherein both the write/read head and the data carrier are arranged on added parts adjacent to the plate-like supports.

10. A construction machine with a quick coupler in accordance with claim 3, wherein both the write/read head and the data carrier are arranged on added parts adjacent to the plate-like supports.

11. A construction machine with a quick coupler in accordance with claim 2, wherein complete data records with the information specific to the tool are included on the data carrier.

12. A construction machine with a quick coupler in accordance with claim 3, wherein complete data records with the information specific to the tool are included on the data carrier.

13. A construction machine with a quick coupler in accordance with claim 4, wherein complete data records with the information specific to the tool are included on the data carrier.

14. A construction machine with a quick coupler in accordance with claim 2, wherein a cleaning system which is in present for the coupling system and which can be set onto the plate-like support can also be used for the cleaning of the surface of the write/read head and of the surface of the data carrier.

15. A construction machine with a quick coupler in accordance with claim 3, wherein a cleaning system which is in present for the coupling system and which can be set onto the plate-like support can also be used for the cleaning of the surface of the write/read head and of the surface of the data carrier.

16. A construction machine with a quick coupler in accordance with claim 4, wherein a cleaning system which is in present for the coupling system and which can be set onto the plate-like support can also be used for the cleaning of the surface of the write/read head and of the surface of the data carrier.

17. A construction machine with a quick coupler in accordance with claim 5, wherein a cleaning system which is in present for the coupling system and which can be set onto the plate-like support can also be used for the cleaning of the surface of the write/read head and of the surface of the data carrier.

18. A construction machine with a quick coupler in accordance with claim 6, wherein a cleaning system which is in present for the coupling system and which can be set onto the plate-like support can also be used for the cleaning of the surface of the write/read head and of the surface of the data carrier.

19. A construction machine with a quick coupler in accordance with claim 2, wherein the forces to be transmitted from the construction machine to the tool can be limited in pre-settable ranges in accordance with the transmitted data.

20. A construction machine with a quick coupler in accordance with claim 3, wherein the forces to be transmitted from the construction machine to the tool can be limited in pre-settable ranges in accordance with the transmitted data.

* * * * *